US008381953B2

(12) United States Patent
Vennemeyer

(10) Patent No.: US 8,381,953 B2
(45) Date of Patent: Feb. 26, 2013

(54) CONCEAL AND CARRY GUN HOLSTER

(76) Inventor: Alfred Vennemeyer, Englewood, OH (US)

( * ) Notice: Subject to any disclaimer, the term of this patent is extended or adjusted under 35 U.S.C. 154(b) by 352 days.

(21) Appl. No.: 12/877,417

(22) Filed: Sep. 8, 2010

(65) Prior Publication Data

US 2011/0132951 A1 Jun. 9, 2011

Related U.S. Application Data

(60) Provisional application No. 61/266,736, filed on Dec. 4, 2009.

(51) Int. Cl.
*F41C 33/02* (2006.01)
*F41C 33/04* (2006.01)

(52) U.S. Cl. ..... 224/192; 224/660; 224/912

(58) Field of Classification Search ..... 224/587, 224/625, 661, 262, 193, 198, 911, 912, 914, 224/250, 930, 623, 660, 192
See application file for complete search history.

(56) References Cited

U.S. PATENT DOCUMENTS

| | | | | |
|---|---|---|---|---|
| 3,797,715 | A | 3/1974 | Scialdone | |
| 4,022,361 | A | 5/1977 | Devlin | |
| 5,054,671 | A | 10/1991 | Else | |
| 5,465,429 | A | 11/1995 | Rogers et al. | |
| 5,775,558 | A * | 7/1998 | Montalbano | 224/627 |
| 6,029,872 | A * | 2/2000 | Ellington | 224/251 |
| 6,293,446 | B1 * | 9/2001 | Nielsen | 224/271 |
| 6,402,001 | B1 | 6/2002 | Madarang | |
| 6,478,202 | B1 * | 11/2002 | Glock | 224/198 |
| 6,755,331 | B2 * | 6/2004 | Rassias | 224/243 |
| 7,204,395 | B2 * | 4/2007 | Gallagher | 224/192 |
| 7,950,554 | B2 * | 5/2011 | Hoffner et al. | 224/661 |
| 2002/0139825 | A1 | 10/2002 | Madarang | |
| 2004/0026471 | A1 | 2/2004 | Gallagher | |
| 2010/0181353 | A1 | 7/2010 | Craighead | |

FOREIGN PATENT DOCUMENTS

| | | | |
|---|---|---|---|
| DE | 102007049954 | A1 * | 4/2009 |
| GB | 2396286 | A * | 6/2004 |

* cited by examiner

*Primary Examiner* — Justin Larson
(74) *Attorney, Agent, or Firm* — Dinsmore & Shohl LLP

(57) ABSTRACT

A gun holster fastening system for supporting a handgun in a position proximate to the ribcage area of the wearer is provided. The gun holster fastening system including a holster case having a pistol receiving compartment, and a holster support band attached to the holster case. The holster support band is sized to extend around a wearer's ribcage. The system also includes holster support strut sized to span between the wearer's ribcage area and a wearer's trouser waistband area, such that the holster support strut has a proximate end adjacent to the holster case, a distal end, an internal face, and an external face. The holster support strut is configured to support the gun fastening system and prevent the holster case and holster support band from moving down a wearer's ribcage. The distal end has a plurality of belt cleats which extend from the external face of the holster support strut to define at least one belt channel.

13 Claims, 4 Drawing Sheets

CONCEAL AND CARRY GUN HOLSTER

CROSS-REFERENCE TO RELATED APPLICATIONS

This application claims the benefit of U.S. Provisional Application Ser. No. 61/266,736, filed Dec. 4, 2009.

BACKGROUND

Conceal and carry handgun holsters are widely available, and commonly feature a holster case to store a firearm, and an attachment system configured to retain the holster case close to a wearer's body. A torso-attachment type holster is one such design.

Although conceal and carry handgun holsters are designed to provide comfort to a wearer, they often fall short. The weight of the firearm often causes the holster and holster band to slide, move, and detach. Furthermore, the torso-attachment type holsters may substantially limit the wearer's option for personal dress.

Accordingly, there remains a need for a conceal and carry holster design that provides maximum comfort, excellent handgun concealment, and more options for personal dress. Furthermore, there remains a need for a single holster design that may be used for multiple concealed carrying applications.

SUMMARY

The present disclosure relates generally to a conceal and carry gun holster. Although the holster support strut of the present disclosure is not limited to particular holster configurations, for the purposes of illustration, the holster support strut is illustrated herein with reference to specific holster configurations.

In accordance with one embodiment of the present disclosure, A gun holster fastening system for supporting a handgun in a position proximate to the ribcage area of the wearer is provided. The gun holster fastening system including a holster case having a pistol receiving compartment, and a holster support band attached to the holster case. The holster support band is sized to extend around a wearer's ribcage. The system also includes holster support strut sized to span between the wearer's ribcage area and a wearer's trouser waistband area, such that the holster support strut has a proximate end adjacent to the holster case, a distal end, an internal face, and an external face. The holster support strut is configured to support the gun fastening system and prevent the holster case and holster support band from moving down a wearer's ribcage. The distal end has a plurality of belt cleats which extend from the external face of the holster support strut to define at least one belt channel.

In accordance with another embodiment of the present disclosure, a gun holster support strut is provided. The gun holster support strut sized to span between a wearer's ribcage area and a wearer's trouser waistband area. The holster support strut includes a proximate end having a holster case attachment device, a distal end, an internal face, and an external face. The distal end includes a plurality of belt cleats which extend from the external face of the holster support strut to define at least one belt channel.

In accordance with another embodiment of the present disclosure, a gun holster fastening system for supporting a handgun in a position proximate to the ribcage area of the wearer is provided. The gun holster fastening system includes a holster case having a pistol receiving compartment, and a holster support band attached to the holster case. The holster support band extends around the wearer's ribcage. The gun holster fastening system also includes a holster support strut sized to span between the wearer's ribcage area and a wearer's trouser waistband area. The holster support strut includes a proximate end adjacent to the holster case, a distal end, an internal face, and an external face, wherein the proximate end of the holster support strut connects to the holster case. The holster support strut is configured to support the gun fastening system and prevent the holster case and holster support band from moving down a wearer's ribcage. The holster support strut 16 has a length ranging from about 10 cm to about 25 cm, and a width ranging from about 1.5 cm to about 6 cm. The distal end includes a plurality of belt cleats which extend from the external face of the holster support strut to define at least one belt channel, wherein the belt channel has a width ranging from about 0.1 cm to about 6 cm and a depth ranging from about 0.1 cm to about 2 cm.

BRIEF DESCRIPTION OF THE SEVERAL VIEWS OF THE DRAWINGS

The following detailed description of specific embodiments of the present disclosure can be best understood when read in conjunction with the following drawings, where like structure is indicated with like reference numerals and in which.

DETAILED DESCRIPTION

Figure 1:
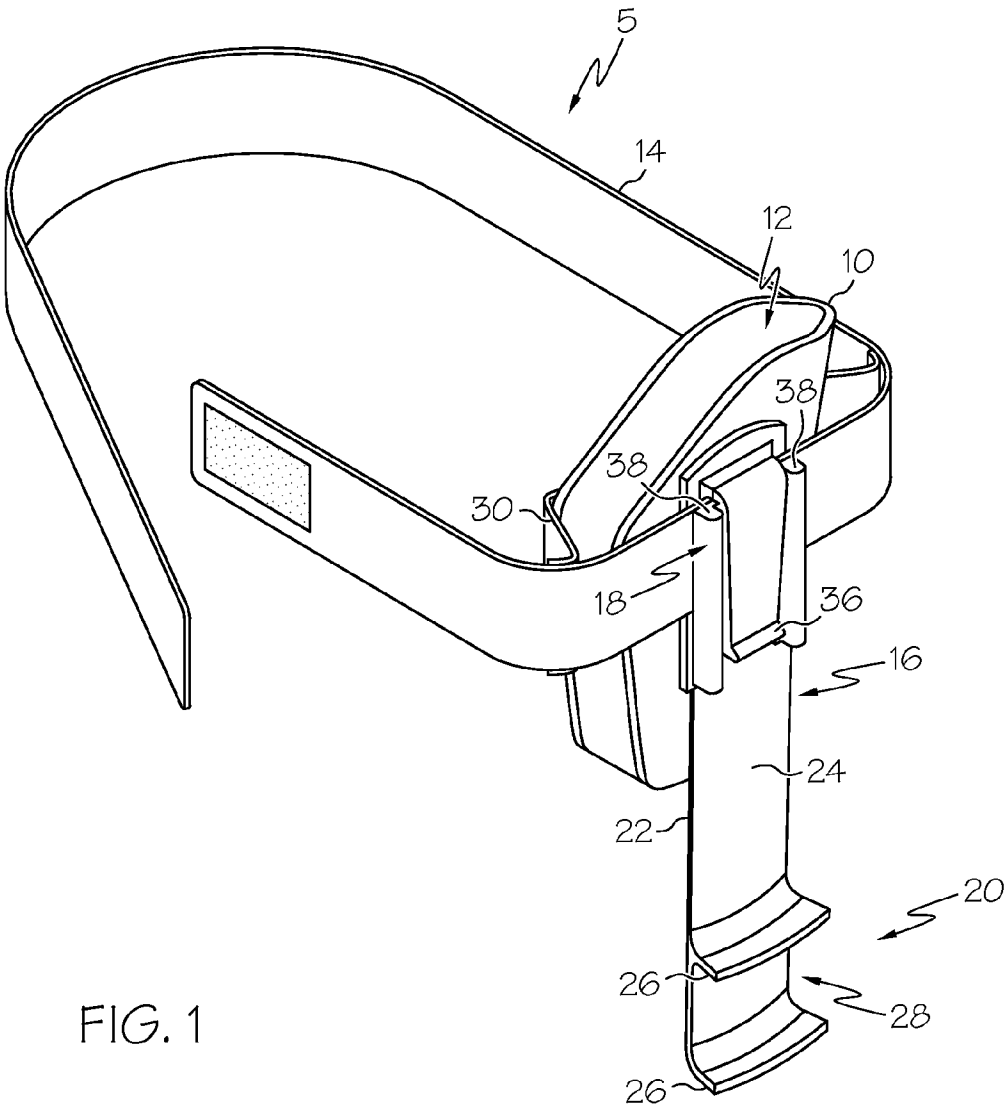
FIG. 1 shows a gun holster fastening system in accordance with one or more embodiments.

Referring initially to FIG. 1, in accordance with one embodiment, the gun holster fastening system 5 comprises a holster case 10 comprising a pistol receiving compartment 12. The gun holster fastening system 5 also comprises a holster support band 14 attached to the holster case 10, wherein the holster support band 14 is sized to extend around the wearer's ribcage. The gun holster fastening system 5 further comprises a holster support strut 16 sized to span between a wearer's ribcage area and a wearer's trouser waistband area. The holster support strut 16 comprises a proximate end 18 adjacent to the holster case 10, a distal end 20, an internal face 22, and an external face 24. The holster support strut 16 is configured to support the gun fastening system 5 and prevent the holster case 10 and holster support band 14 from moving or sliding along the wearer's torso. The distal end 20 comprises a plurality of belt cleats 26 that extend from the external face 24 of the holster support strut 16 to define at least one belt channel 28.

The gun holster fastening system 5 is designed to attach and support a holster and firearm proximate to a wearer's ribcage area. The ribcage area comprises the area of a wearer's body adjacent to the wearer's ribcage. By placing the holster and firearm in a position along the ribcage, it is readily accessible by the wearer, and may be easily concealed underneath a wearer's shirt. The gun holster fastening system 5 described herein may be worn outside the shirt, or inside the shirt as described below. Accordingly, the gun holster fastening system 5 allows a wearer to don apparel either outside the belt, or tucked inside the belt, all while experiencing improved comfort over other torso-attachment type holster designs.

The holster case 10 comprises a pistol receiving compartment 12 sized and shaped to accept and retain a firearm. The size and shape of the pistol receiving compartment 12 may vary to accommodate a range of firearm types and sizes. The gun holster fastening system 5 is designed to support a variety of firearms while still preserving the wearer's comfort. The holster case 10 may comprise a rigid plastic, leather, synthetic, or other fabric as will be appreciated by one of ordinary skill.

Figure 2:
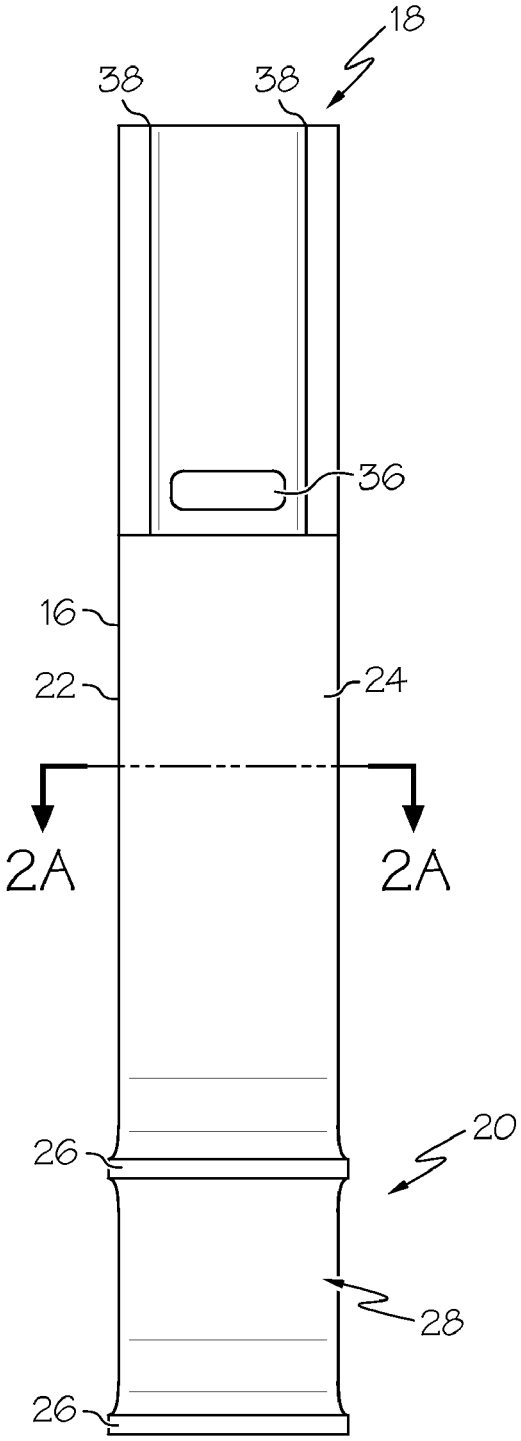
FIG. 2 shows a front view of holster support strut in accordance with one or more embodiments.

Referring to FIGS. 1 and 2, in another embodiment the proximate end 18 of the holster support strut 16 may comprise a plurality of lateral holster supports 38 configured to fix the position of the holster case 10 on the holster support band 14. The lateral holster supports 38 may comprise at least two longitudinally oriented strips. The lateral holster supports 38 may abut a protrusion of the holster case 10 such that the holster case 10 does not move laterally. Alternatively, the lateral holster supports 38 may interact with grooves located on the holster case 10 to restrict the lateral movement of the holster case 10. Alternatively, the lateral holster supports 38 may be provided as part of the holster support band 14. The lateral holster supports 38 may take other shapes and designs sufficient to stabilize the holster case 10.

Referring again to FIG. 1, the gun holster fastening system 5 also comprises a holster support band 14. The holster support band 14 is attached to the holster case 10 to retain the longitudinal position of the holster case 10 on ribcage of the wearer. The holster support band 14 is sized to extend around the wearer's ribcage. The holster support band 14 may comprise a variety of materials and configurations, such as mesh, elastic, leather, plastic, and fabric. The holster support band 14 may attach to the holster case 10 with a variety of fastening systems, such as snaps, hooks and loops, buckles, and cooperative slots and protrusions. The holster support band 14 may have a width dimension ranging from about 1 cm to about 12 cm, or from about 2 cm to about 10 cm. The holster support band 14 is designed and configured to hold the holster case 10 lightly against the wearer's body in order to provide maximum concealment. As a result, in one embodiment, the holster support band 14 can be a narrow design, requiring minimal tension adjustment for maximum comfort.

In another embodiment, referring to FIG. 1, the gun holster fastening system 5 may comprise a holster retaining band 30. In one configuration, the holster case 10 may be mounted to the holster support band 14 with a holster retaining band 30. The holster retaining band 30 is mounted on the inside of the holster support band 14 such that the holster retaining band 30 surrounds the holster case 10. The holster retaining band 30 may comprise elastic or some other flexible material to firmly press the holster case 10 against the holster support band 14. In addition, the holster retaining band 30 may thread through a mounting bracket located on the holster case 10, or snap to the case, as will be appreciated by one of ordinary skill. Alternatively, the gun fastening system 5 may be designed such that the holster case 10 is connected to the outside of the holster support band 14.

The gun fastening system 5 comprises a holster support strut 16. The holster support strut 16 is designed to support the total weight of the handgun and holster near the ribcage on a wearer's body, thus preventing the discomfort associated with substantial weight bearing on the holster support band 14. The holster support strut 16 sized to span between the wearer's ribcage area and a wearer's trouser waistband area. The holster support strut 16 comprises a proximate end 18 adjacent to the holster case 10. The holster support strut 16 also comprises a distal end 20 opposite the proximate end 18, along the longitudinal axis of the holster support strut 16. The holster support strut 16 comprises an internal face 22 and an external face 24. The internal face 22 is adjacent to the wearer's body, whereas the external face 24 is directed away from the wearer's body.

Referring to FIGS. 1 and 2, the holster support strut 16 may be attached to the gun fastening system 5 in a variety of ways. The holster support strut 16 may be sewn or fastened into the holster support band 14 or holster case 10. Alternatively, the holster support strut 16 may be attached to the holster support band 14 or holster case 10 with a holster attachment device 36, such as a clip, clip window or other fastening system. In one configuration, if the holster support strut 16 is being utilized with a pre-purchased holster, the pre-purchased holster may contain a clip finger having a projection. The holster attachment device 36 may comprise a window which stops the pre-purchased holster from separating from the holster support strut 16 when removing the firearm, and allows a clip finger to interact with the window.

Figure 3:
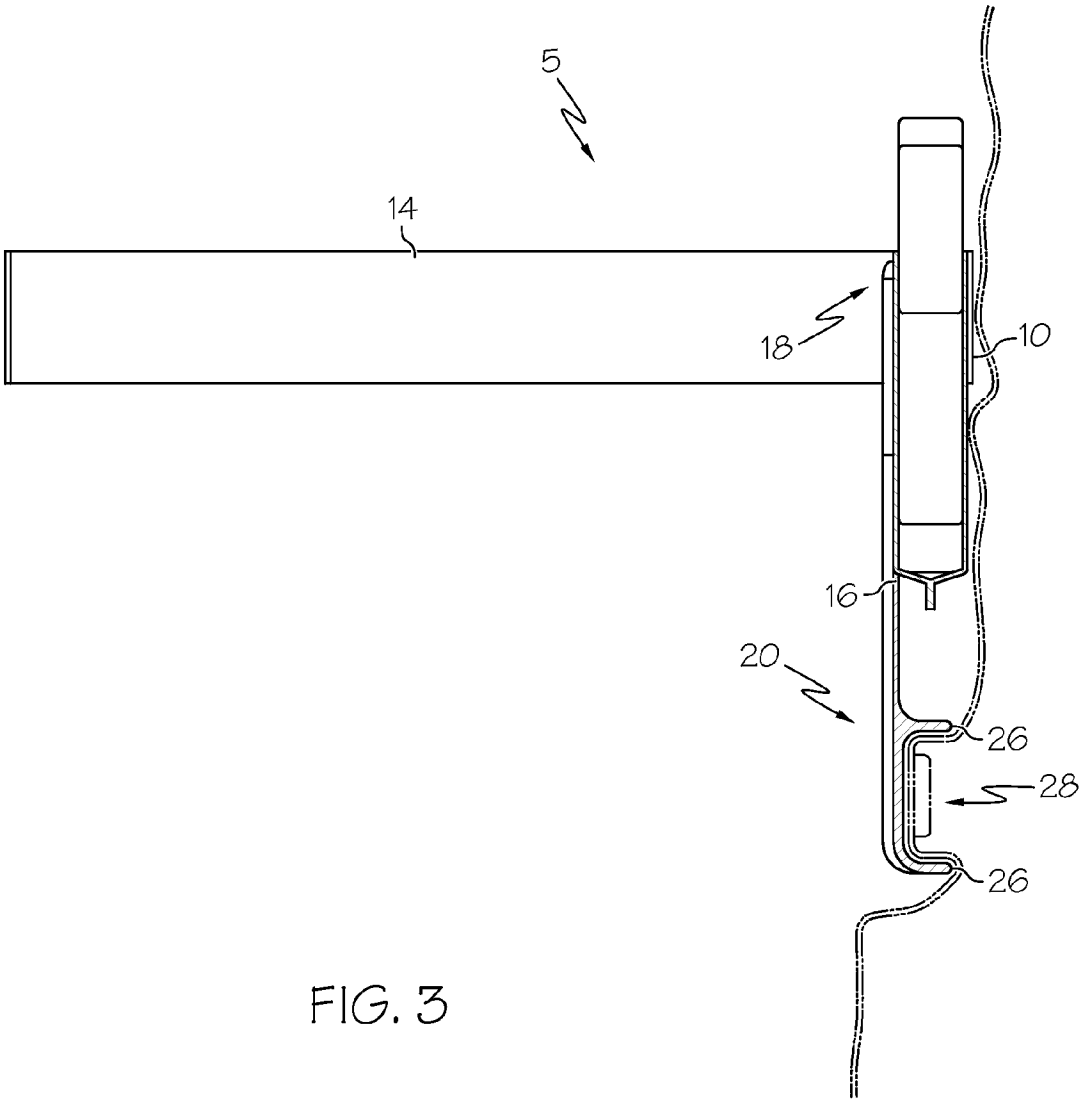
FIG. 3 shows a cross sectional view of a gun fastening system on a wearer in accordance with one or more embodiments.

Referring to FIG. 3, the distal end 20 of the holster support strut 16 comprises a plurality of belt cleats 26 which extend from the external face 24 of the holster support strut 16 to define at least one belt channel 28. The plurality of belt cleats 26 in combination with the waistbelt of a user, longitudinally secure the holster support strut 16, and thus allows the holster support strut 16 to provide support to the gun holster case 10. The belt cleats 26 are designed to be placed inside or outside of a wearer's trousers. When a wearer's waistbelt is tightened, the belt channel 28 is firmly engaged by the waistbelt, and thus fixes the position of the holster support strut 16. Any number of belt cleats 26 may be provided. For example, 6 belt cleats 26 may be provided to define at least 3 belt channels 28. Thereby, a single support strut 16 may fit wearers having different torso lengths.

The belt cleats 26 may extend from the external face 24 for a dimension sufficient to retain a belt in a position between the belt cleats 26. In one configuration, the belt cleats 26 have a dimension extending from the external face 24 marginally larger than the sum of the thicknesses of the shirt fabric, the trouser fabric, and waist belt. Thus, if the holster support strut 16 is within the wearer's shirt, the belt cleats 26 define a deep enough belt channel 28 to accommodate the shirt, the trousers, and the waistbelt, yet still be firmly engaged by a wearer's belt, thus providing support for the holster support strut 16.

The holster support strut 16 is sized and designed such that, when worn, the distal end 20 is adjacent to the wearer's trouser waistband area. This allows the wearer's belt to press inwardly into the belt channel 28. Therefore, in operation, the holster support strut 16 spans from the wearer's belt, to the holster case 10 and the holster support band 14, thus providing holster support and additional comfort.

Figure 2A:
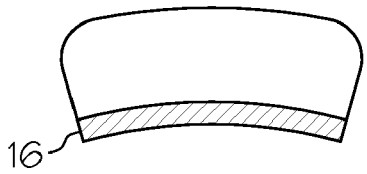
FIG. 2A shows a cross-sectional view of a holster support strut in accordance with one or more embodiments.

Referring to FIG. 2A, the holster support strut 16 may comprise a variety of shapes and sizes to aid in the comfort of the wearer. In one embodiment, the holster support strut 16 is curved convexly outward from the internal face 22 along its latitudinal dimension. This curvature has a radius that substantially matches the latitudinal wearer's radius of a wearer's torso. Because the holster support strut 16 may abut the wearer's torso, providing such a curvature may improve a wearer's comfort level.

Figure 4B:
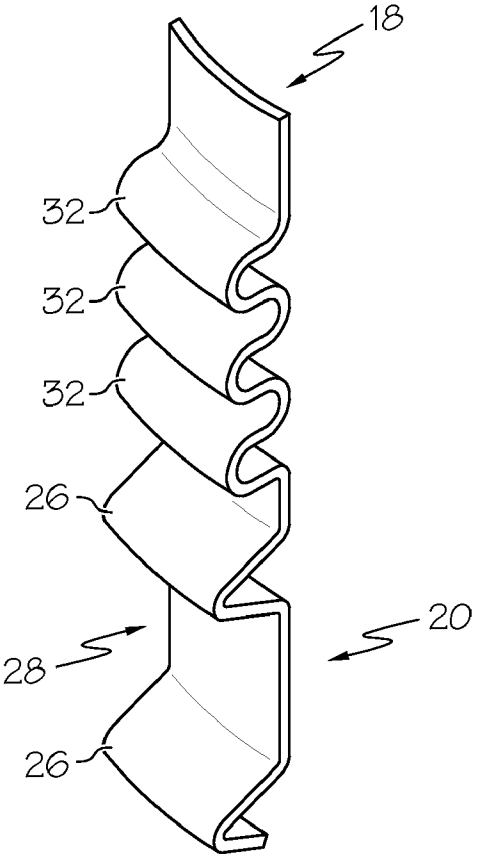
FIG. 4B shows a front perspective view of a holster support strut in accordance with yet another embodiment.
Figure 4A:
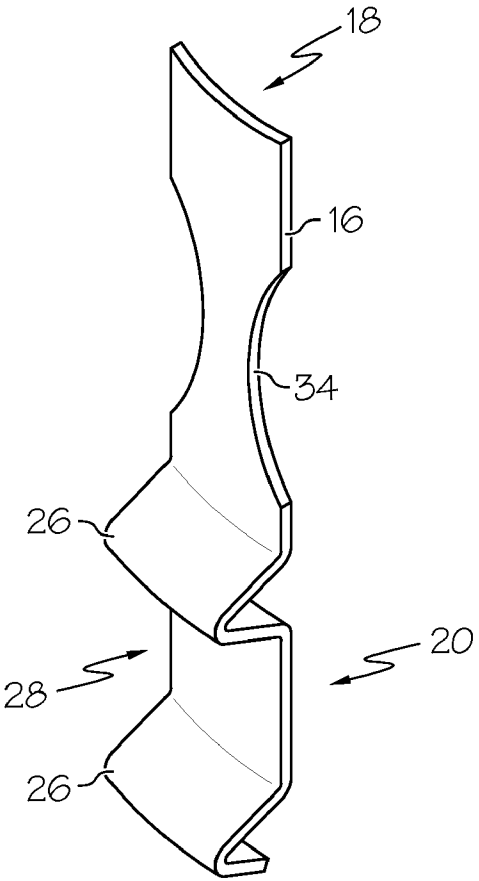
FIG. 4A shows a front perspective view of a holster support strut in accordance with another embodiment.

Referring to FIG. 4A, in another embodiment, the holster support strut 16 comprises an hourglass shape. The holster support strut 16 comprises a flexing middle portion 34 having a width less than about 60%, or about 70% or about 80% of the width dimension of the proximate end 18 and the distal end 20. The narrower middle portion 34 allows the holster support strut 16 to flex easier, thus providing the wearer with additional comfort that would not be obtained with a more rigid design. In one configuration, the proximate end 18 and the distal end 20 have substantially the same width.

Referring to FIG. 4B, in another embodiment, in yet another embodiment, the holster support strut 16 comprises at least one spring bend 32 to provide longitudinal flexibility and additional comfort to the wearer. The holster support strut 16 may have a number of spring bends ranging from about 2 to about 5, or from about 2 to about 4. The size of the spring bends 32 may vary depending on the weight of firearm. Additionally, the proximity of the spring bends 32 to one another may also vary depending on the size of the holster support strut 16. When a wearer moves, sits, or otherwise adjusts, the spring bends 32 may flex, allowing the holster support strut 16 to shadow the movements of the wearer.

The holster support strut 16 have a range of dimensions, depending on the size of the wearer, the length of the wearer's torso, the girth of a wearer's waist and more. The holster support strut 16 has thickness and section modulus designed to easily flex with movements of the body (e.g. bending, twisting, and sitting). The holster support strut 16 is also designed with a cross sectional area that will bend and twist with body movements, thus aiding personal comfort of the wearer. The holster support strut 16 may have a length ranging from about 5 cm to about 30 cm, or from 5 cm to about 20 cm, or about 10 cm to about 25 cm. The holster support strut 16 may have a width ranging from about 1.5 cm to about 6 cm, or from about 2 cm to about 5 cm, or from about 2 cm to about 4 cm. The holster support strut 16 may have a thickness ranging from about 0.01 cm to about 0.5 cm, or about 0.1 cm to about 0.3 cm or about 0.2 cm.

The holster support strut 16 may comprise a flexible material that is safe for body contact. In one configuration, the holster support strut 16 comprises a flexible plastic material selected from polystyrene, vivak, and combinations thereof. However, it is also contemplated that the holster support strut 16 may be manufactured from materials suitable to perform the functions described throughout this disclosure, such as plastic, natural materials, metal, and rubber.

Referring to FIG. 2, in one embodiment, a gun holster support strut 16 may be sold individually and integrated into existing holster case 10 and support systems. In addition, a separately purchased holster system may be combined with both the holster support band 14 and holster support strut 16, or either, described herein. In such an embodiment, a purchased holster case may be mounted in the holster retaining band 30 thus requiring no modifications to the purchased holster. This allows a separately purchased holster to be used as a "inside the belt" holster or "inside the shirt" holster. In such an embodiment, the holster support strut 16 may comprise a holster attachment device 36 described above The holster support band 14 may also comprise a magazine pouch, an adjustment buckle, and other features as will be appreciated by one of ordinary skill.

It is also noted that recitations herein of "at least one" component, element, etc., should not be used to create an inference that the alternative use of the articles "a" or "an" should be limited to a single component, element, etc.

It is noted that recitations herein of a component of the present disclosure being "programmed" in a particular way, "configured" or "programmed" to embody a particular property, or function in a particular manner, are structural recitations, as opposed to recitations of intended use. More specifically, the references herein to the manner in which a component is "programmed" or "configured" denotes an existing physical condition of the component and, as such, is to be taken as a definite recitation of the structural characteristics of the component.

It is noted that terms like "preferably," "commonly," and "typically," when utilized herein, are not utilized to limit the scope of the claimed invention or to imply that certain features are critical, essential, or even important to the structure or function of the claimed invention. Rather, these terms are merely intended to identify particular aspects of an embodiment of the present disclosure or to emphasize alternative or additional features that may or may not be utilized in a particular embodiment of the present disclosure.

For the purposes of describing and defining the present invention it is noted that the terms "substantially" and "approximately" are utilized herein to represent the inherent degree of uncertainty that may be attributed to any quantitative comparison, value, measurement, or other representation. The terms "substantially" and "approximately" are also utilized herein to represent the degree by which a quantitative representation may vary from a stated reference without resulting in a change in the basic function of the subject matter at issue.

Having described the subject matter of the present disclosure in detail and by reference to specific embodiments thereof, it is noted that the various details disclosed herein should not be taken to imply that these details relate to elements that are essential components of the various embodiments described herein, even in cases where a particular element is illustrated in each of the drawings that accompany the present description. Rather, the claims appended hereto should be taken as the sole representation of the breadth of the present disclosure and the corresponding scope of the various inventions described herein. Further, it will be apparent that modifications and variations are possible without departing from the scope of the invention defined in the appended claims. More specifically, although some aspects of the present disclosure are identified herein as preferred or particularly advantageous, it is contemplated that the present disclosure is not necessarily limited to these aspects.

It is noted that one or more of the following claims utilize the term "wherein" as a transitional phrase. For the purposes of defining the present invention, it is noted that this term is introduced in the claims as an open-ended transitional phrase that is used to introduce a recitation of a series of characteristics of the structure and should be interpreted in like manner as the more commonly used open-ended preamble term "comprising."

What is claimed is:

1. A gun holster fastening system for supporting a handgun in a position proximate to the ribcage area of the wearer, the gun holster fastening system comprising:

a holster case comprising a pistol receiving compartment;

a holster support band attached to the holster case, wherein the holster support band is sized to extend around a wearer's ribcage;

a holster support strut sized to span between the wearer's ribcage area and a wearer's trouser waistband area, wherein:

the holster support strut comprises a proximate end adjacent to the holster case, a distal end, an internal face that faces the wearer in use and to which the holster case is attached, and an external face that faces away from the user in use the holster support strut is configured to support the gun fastening system and prevent the holster case and holster support band from moving down a wearer's ribcage; and the distal end extends below the holster case and comprises a plurality of belt cleats which extend from the external face of the holster support strut to define at least one belt channel.

2. The gun holster fastening system of claim 1, wherein the proximate end of the holster support strut connects to the holster case.

3. The gun holster fastening system of claim 1, further comprising a holster retaining band, wherein the holster case is mounted to the holster support band with the holster retaining band mounted on the interior of the holster support band such that the holster retaining band surrounds the holster case.

4. The gun holster fastening system of claim 1, wherein the holster case is connected to the outside of the holster support band.

5. The gun holster fastening system of claim 1, wherein the belt channel has a width ranging from about 0.1 cm to about 6 cm and a depth ranging from about 0.1 cm to about 2 cm.

6. The gun holster of claim 1, wherein the holster support strut 16 has a length ranging from about 10 cm to about 25 cm, and a width ranging from about 1.5 cm to about 6 cm.

7. The gun holster fastening system of claim 1, wherein holster support strut comprises at least one longitudinally oriented spring bend.

8. The gun holster fastening system of claim 1, wherein the holster support strut is curved convexly outward from the internal face along its latitudinal dimension.

9. The gun holster fastening system of claim 1, wherein the holster support strut comprises an hourglass shape, wherein the proximate end and the distal end have substantially the same width, and the holster support strut further comprises a flexing middle portion having a width less than about 60% of the width of the proximate end or distal end.

10. The gun holster fastening system of claim 1, wherein the holster support strut comprises a flexible plastic material selected from polystyrene, vivak, and combinations thereof.

11. The gun holster support strut of claim 1, wherein the holster support strut has a thickness ranging from about 0.01 cm to about 0.3 cm.

12. The gun holster support strut of claim 1, wherein the holster support strut comprises a plurality of lateral holster supports, wherein the lateral holster supports comprise a plurality longitudinally oriented strips positioned to prevent lateral movement of a holster case.

13. A gun holster fastening system for supporting a handgun in a position proximate to the ribcage area of the wearer, the gun holster fastening system comprising:

a holster case comprising a pistol receiving compartment;

a holster support band attached to the holster case, wherein the holster support band extends around the wearer's ribcage;

a holster support strut sized to span between the wearer's ribcage area and a wearer's trouser waistband area, wherein:

the holster support strut comprises a proximate end adjacent to the holster case, a distal end, an internal face that faces the wearer in use and to which the holster case is attached, and an external face that faces away from the user in use, wherein the proximate end of the holster support strut connects to the holster case;

the holster support strut is configured to support the gun fastening system and prevent the holster case and holster support band from moving down a wearer's ribcage, wherein the holster support strut 16 has a length ranging from about 10 cm to about 25 cm, and a width ranging from about 1.5 cm to about 6 cm; and the distal end extends below the holster case and comprises a plurality of belt cleats which extend from the external face of the holster support strut to define at least one belt channel, wherein the belt channel has a width ranging from about 0.1 cm to about 6 cm and a depth ranging from about 0.1 cm to about 2 cm.

* * * * *